US005188557A

United States Patent [19]

Brown

[11] Patent Number: 5,188,557

[45] Date of Patent: Feb. 23, 1993

[54] TOY ROCKET APPARATUS

[76] Inventor: Randall L. Brown, Rte. 1, Box. 1278, Paul, Id. 83347

[21] Appl. No.: 819,967

[22] Filed: Jan. 13, 1992

[51] Int. Cl.[5] ..... A63H 27/26; A63H 29/00; F41B 11/08; B64F 1/04

[52] U.S. Cl. ..... 446/212; 446/231; 446/429; 124/57; 244/63; 244/3.29

[58] Field of Search ..... 446/52, 212, 211, 176, 446/227, 230, 231, 473, 429, 487, 489; 124/56, 57, 63, 65; 244/73 R, 63, 3.29, 3.28, 3.3

[56] References Cited

U.S. PATENT DOCUMENTS

| | | | |
|---|---|---|---|
| 1,721,704 | 7/1929 | Madaschi | 446/429 X |
| 2,409,653 | 10/1946 | Andur | 124/63 |
| 2,759,297 | 8/1956 | Lewis | 124/57 X |
| 3,046,694 | 7/1962 | Holderer | 124/57 X |
| 3,063,375 | 11/1962 | Hawley et al. | 244/3.28 X |
| 3,121,292 | 2/1964 | Butler et al. | 446/212 |
| 3,739,764 | 6/1973 | Allport | 446/429 X |
| 3,962,818 | 6/1976 | Pippin, Jr. | 446/212 |
| 4,149,338 | 4/1979 | Wolf | 446/197 X |
| 4,223,472 | 9/1980 | Fekete et al. | 446/231 X |
| 4,398,682 | 8/1983 | Bithrey | 244/3.29 |

FOREIGN PATENT DOCUMENTS

| | | | |
|---|---|---|---|
| 161579 | 5/1954 | Australia | 446/212 |

*Primary Examiner*—D. Neal Muir
*Attorney, Agent, or Firm*—Leon Gilden

[57] ABSTRACT

A toy rocket to include a cylindrical body formed with a conical upper end portion, with the conical end portion formed of a flexible material, the cylindrical body formed of a rigid material and including a launcher structure, including a first conduit to receive a pneumatic air supply therethrough, with a first conduit orthogonally oriented and in pneumatic communication with a second conduit. The second conduit terminating in a sivel connection, with the swivel connection mounting a mounting tube thereon. The mounting tube is arranged for projection through a floor of the rocket into a first chamber containing a fluid propulsion medium therewithin. Pressurizing of the first chamber effects subsequent release of the rocket relative to the mounting tube for projection along a trajectory of flight.

5 Claims, 4 Drawing Sheets

TOY ROCKET APPARATUS

BACKGROUND OF THE INVENTION

1. Field of the Invention

The field of invention relates to toy rocket apparatus, and more particularly pertains to a new and improved toy rocket apparatus wherein the same is arranged for the ease of use and mounting of a toy rocket structure relative to a launch platform.

2. Description of the Prior Art

Toy rocket structure of various types are utilized in the prior art utilizing a gaseous medium for propulsion. Such apparatus is exemplified in the U.S. Pat. No. 3,650,214 to Green; U.S. Pat. No. 3,820,275 to Green; U.S. Pat. No. 4,038,776 to Filipeli; and U.S. Pat. No. 4,076,006 to Breslow, et al.

The prior art has heretofore, however, failed to set forth a fluid propulsion rocket formed with adjustable stabilizer fins and a multi-component body construction as set forth by the instant invention addressing both the problems of ease of use as well as effectiveness in construction and in this respect, the present invention substantially fulfills this need.

SUMMARY OF THE INVENTION

In view of the foregoing disadvantages inherent in the known types of toy rocket apparatus now present in the prior art, the present invention provides a toy rocket apparatus wherein the same utilizes a fluid-pneumatic propulsion medium. As such, the general purpose of the present invention, which will be described subsequently in greater detail, is to provide a new and improved toy rocket apparatus which has all the advantages of the prior art toy rocket apparatus and none of the disadvantages.

To attain this, the present invention provides a toy rocket to include a cylindrical body formed with a conical upper end portion, with the conical end portion formed of a flexible material, the cylindrical body formed of a rigid material and including a launcher structure, including a first conduit to receive a pneumatic air supply therethrough, with a first conduit orthogonally oriented and in pneumatic communication with a second conduit. The second conduit terminating in a swivel connection, with the swivel connection mounting a mounting tube thereon. The mounting tube is arranged for projection through a floor of the rocket into a first chamber containing a fluid propulsion medium therewithin. Pressurizing of the first chamber effects subsequent release of the rocket relative to the mounting tube for projection along a trajectory of flight.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy rocket apparatus which has all the advantages of the prior art toy rocket apparatus and none of the disadvantages.

It is another object of the present invention to provide a new and improved toy rocket apparatus which may be easily and efficiently manufactured and marketed.

It is a further object of the present invention to provide a new and improved toy rocket apparatus which is of a durable and reliable construction.

An even further object of the present invention is to provide a new and improved toy rocket apparatus which is susceptible of a low cost of manufacture with regard to both materials and labor, and which accordingly is then susceptible of low prices of sale to the consuming public, thereby making such toy rocket apparatus economically available to the buying public.

Still yet another object of the present invention is to provide a new and improved toy rocket apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic side view of the launch platform and rocket in a cooperating relationship.

DESCRIPTION OF THE PREFERRED EMBODIMENT

Figure 1:
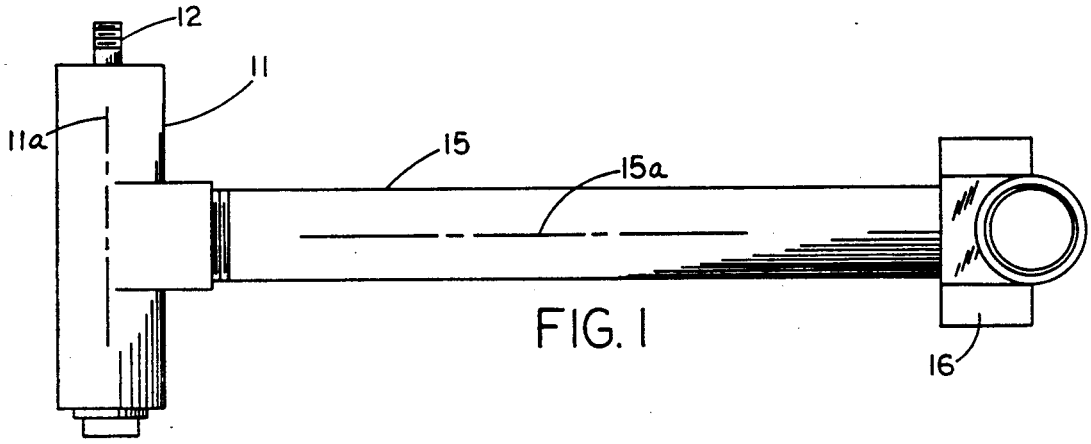
FIG. 1 is an orthographic top view of the launch platform of the invention.

With reference now to the drawings, and in particular to FIGS. 1 to 9 thereof, a new and improved toy rocket apparatus embodying the principles and concepts of the present invention and generally designated by the reference numeral 10 will be described.

Figure 2:
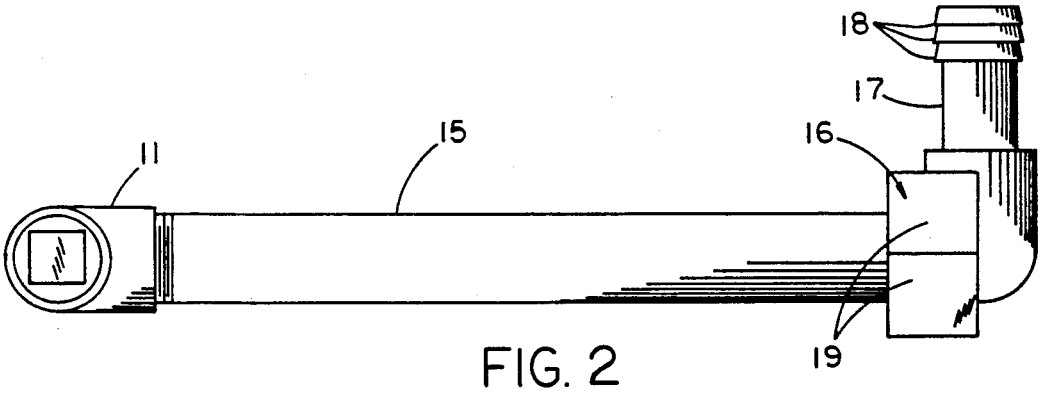
FIG. 2 is an orthographic side view of the launch platform.
Figure 3:
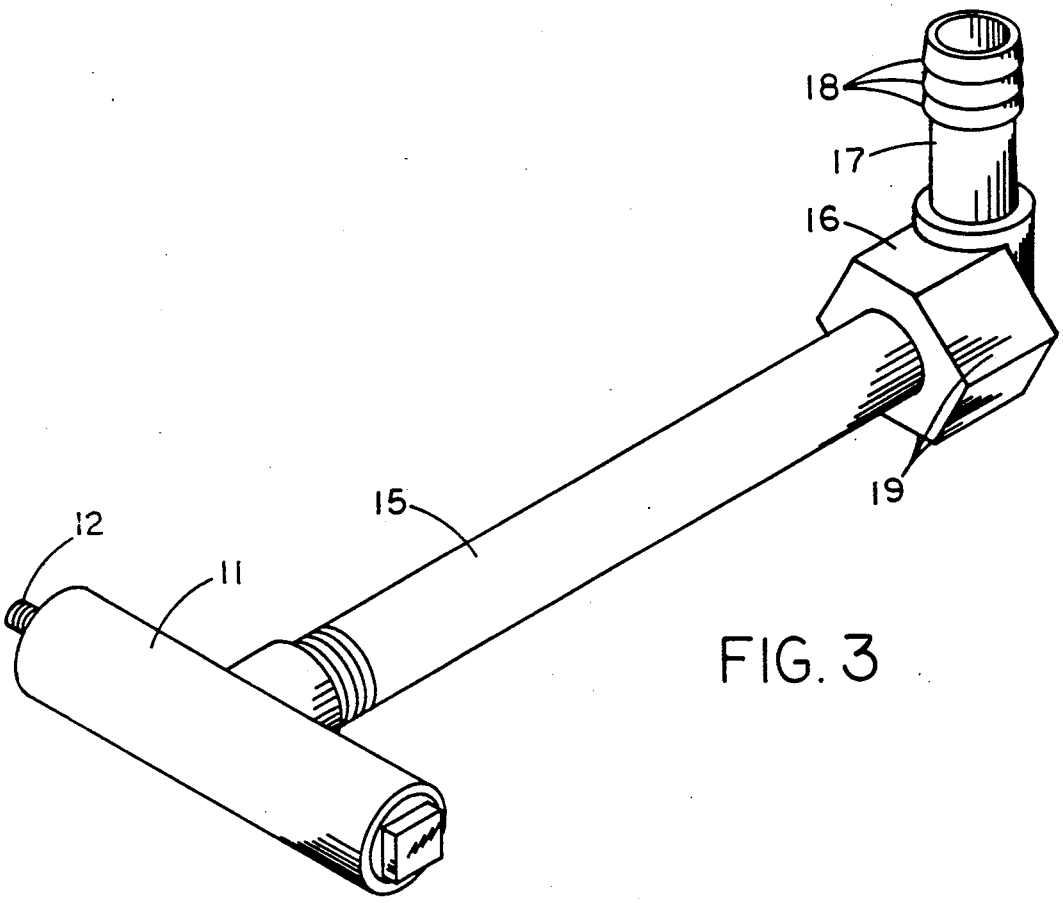
FIG. 3 is an isometric illustration of the launch platform.
Figure 4:
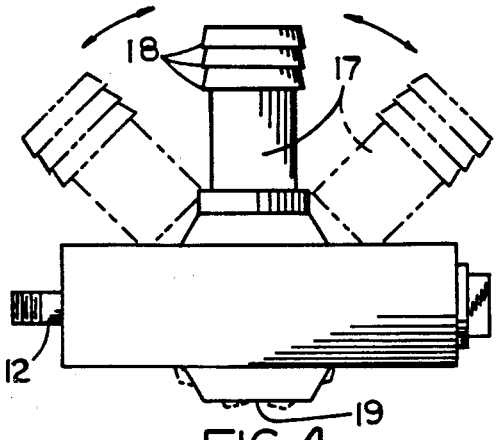
FIG. 4 is an orthographic end view of the launch platform illustrating the pivotal relationship of the mounting tube relative to the platform.
Figure 6:
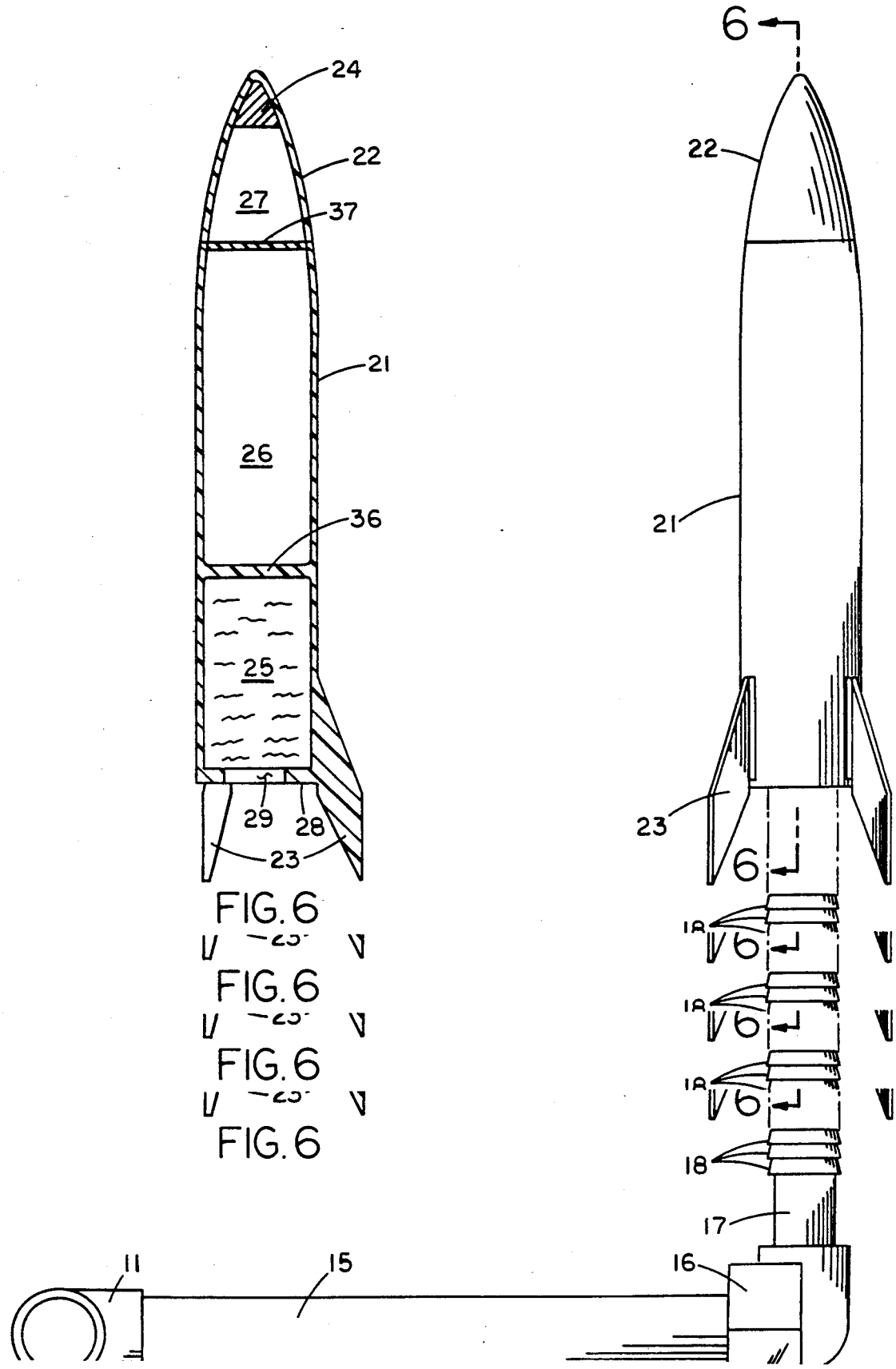
FIG. 6 is an orthographic view, taken along the lines 6—6 of FIG. 5 in the direction indicated by the arrows.
Figure 7:
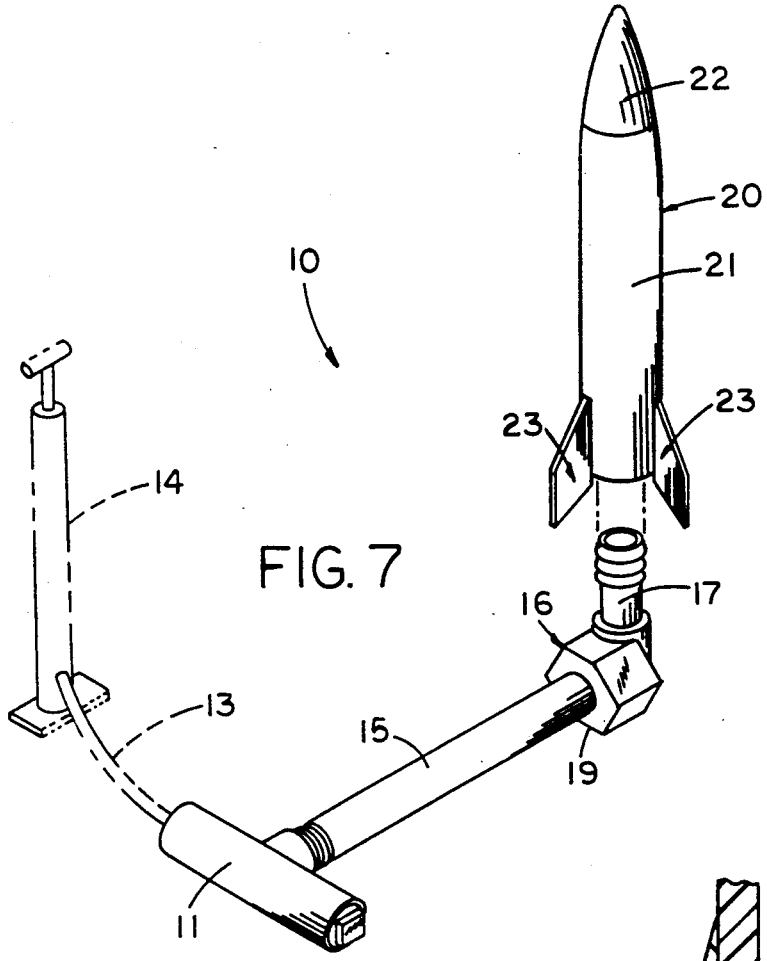
FIG. 7 is an isometric illustration of the instant invention.

More specifically, the toy rocket apparatus 10 of the instant invention essentially comprises a launch platform, as illustrated in the FIGS. 1 and 2, to include a first conduit base tube 11 in pneumatic communication with a second conduit tube 15. The first conduit base tube 11 is defined along a first axis 11*a*, and the second conduit tube 15 directed along a second axis 15*a*, wherein the first and second axes are in a coplanar relationship relative to one another. A nipple 12 is mounted to the first tube 11 in pneumatic communication therewith to receive a pneumatic conduit 13 from a pneumatic pressure delivery source such as a pump or reservoir and the like 14, as illustrated in the FIG. 7. The second conduit tube 15 is oriented at an oblique and preferably an orthogonal angle relative to the first conduit tube and terminates in a swivel socket 16 that is pivotally mounted to a forward distal end of the second conduit tube spaced from the first conduit tube. The swivel socket 16 includes a mounting tube 17 in pneumatic communication through the swivel socket 16 to the second conduit tube 15, with the mounting tube 17 oriented orthogonally relative to the second axis 15*a* in a pivotal relationship. The swivel socket 16 is formed with a plurality of mounting flats 19 thereabout, wherein the mounting flats are oriented in a parallel relationship relative to the second axis 15*a* and are equally spaced from the second axis 15*a* to provide for a stabilizing support surface in the positioning of the mounting tube 17 at a desired angular orientation relative to the launch platform. The use of the parallel ribs 18 mounted to the upper distal end of the mounting tube 17 is arranged for enhanced frictional engagement through the nozzle opening 29 formed within the lower body floor 28 of the rocket member 20. The rocket member 20, as illustrated in the FIG. 6 for example, includes a lower cylindrical body 21 formed of a rigid material terminating in an upper conical body 22 formed of a flexible shock absorbing material. The upper conical body and the lower cylindrical body are coaxially aligned relative to one another. A plurality of stabilizer fins 23 are egually spaced about a lower portion of the lower cylindrical body 21, with the stabilizer fins 23 projecting below the floor 28. A first fluid chamber 25 is formed between the floor 28 and a first rocket web 36, with a rocket web 37 arranged parallel to and above the first rocket web 36 defining a second pneumatically sealed chamber 26 therebetween within the lower body 21. Positioned above the second web 37 is the upper conical body 22 formed with a stabilizer weight member 24 within the upper tip of the upper body 22. A third impact chamber 27 is defined within the upper conical body 22 to enhance shook absorption relative to the rocket member for repeated use of the rocket member.

Figure 8:
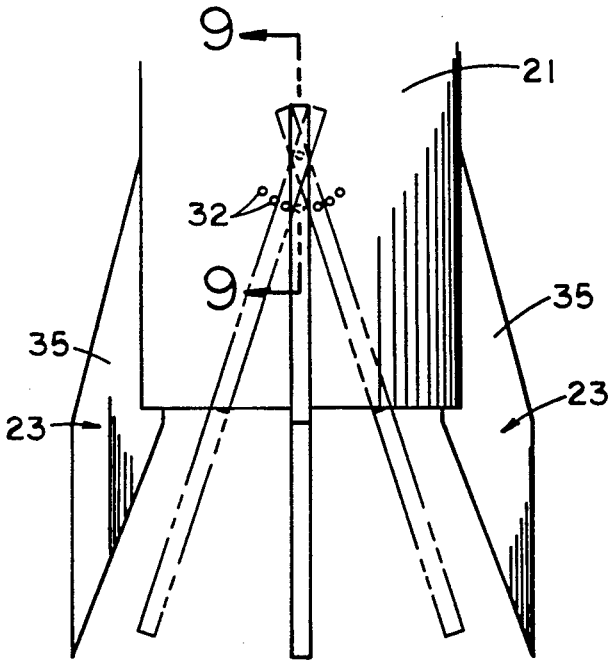
FIG. 8 is an orthographic partial view of the use of adjustable stabilizer fins.
Figure 9:
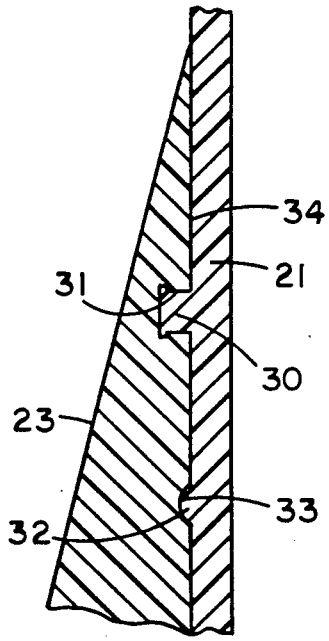
FIG. 9 is an orthographic view, taken along the lines 9—9 of FIG. 8 in the direction indicated by the arrows.

The plurality of stabilizer fins 23 are optionally formed in a manner as illustrated in the FIGS. 8 and 9 to include a stabilizer fin bore 31 pivotally receiving a stabilizer fin axle 30 fixedly mounted and radially oriented relative to the lower body 21 pivotally mounting the stabilizer fin 23 thereabout. A semi-circular array of projecting nipples 32 are formed to the lower body 21 projecting exteriorly thereof and positioned below the axle 30. A selective one of said projecting nipples 32 is arranged for reception with a projecting nipple receiving cavity 33 within the stabilizer fin 23. The stabilizer fin bore 31 and the projecting nipple receiving cavity 33 positioned therebelow are formed within a stabilizer fin inward edge surface 34 oriented between planar side walls 35, wherein each inward edge surface 34 is arranged in contiguous communication with the lower body 21. In this manner, in-flight trajectory manipulation is afforded to individuals in utilization of the rocket structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy rocket apparatus, comprising, a rocket launcher, the rocket launcher including a pneumatic connector nipple directed into the rocket launcher at a first distal end thereof, and a socket member pivotally mounted to the rocket launcher at a second distal end of the rocket launcher, wherein the socket members include a mounting tube positioned thereon, and a pneumatic conduit in pneumatic communication between the connector nipple and the socket member, and a rocket member arranged for receiving the mounting tube therewithin, the rocket member including a lower cylindrical body and an upper conical body mounted to an upper distal end of the lower cylindrical body coaxially aligned with the lower cylindrical body, the lower cylindrical body including a floor, the floor including a nozzle opening directed therethrough, and the nozzle opening arranged for reception of the mounting tube therewithin, and the pneumatic conduit mounted in pneumatic communication with a pneumatic pressure delivery source to direct pneumatic pressure through the rocket launcher into the rocket member to project the rocket member from the mounting tube upon pressurizing of the rocket member interiorly thereof through the mounting tube, and the rocket launcher includes a first conduit base tube formed along a first axis, and a second conduit tube formed along a second axis, with the first axis obliquely oriented relative to the second axis, and the first axis and the second axis in a coplanar relationship, and the swivel socket including a plurality of mounting flats formed to a periphery of the swivel socket, wherein each of the mounting flats are arranged in a parallel equal radial spacing relative to the second axis, and the mounting tube includes a plurality of parallel ribs mounting adjacent the upper distal end of the mounting tube to enhance frictional engagement of the mounting tube within the rocket member through the nozzle opening.

2. An apparatus as set forth in claim 1 wherein the lower cylindrical body includes a first rocket web arranged parallel to and spaced above the floor defining a first fluid chamber therebetween, wherein the fluid chamber including a predetermined quantity of fluid contained therewithin, and a second rocket web spaced above and parallel the first rocket web at an interface between the lower cylindrical body and the upper conical body, wherein the second chamber is pneumatically sealed relative to the first chamber, and a third impact chamber positioned within the upper conical body above the second rocket web, and the lower cylindrical body is formed of a rigid material and the upper conical body is formed of a flexible material, the upper conical body further includes a weighted stabilizer member contained within an upper distal end of the upper conical body.

3. An apparatus as set forth in claim 2 including a plurality of stabilizer fins mounted to the lower cylindrical body, wherein the stabilizer fins include spaced parallel side walls and an inward edge surface in contiguous communication with the lower cylindrical body.

4. An apparatus as set forth in claim 3 wherein each stabilizer fin inward edge surface includes a stabilizer fin bore, and the stabilizer fin bore receives a stabilizer fin axle therewithin, and each stabilizer fin axle pivotally mounts a stabilizer fin relative to the stabilizer fin axle, with the stabilizer fin axle integrally and radially directed into the lower cylindrical body.

5. An apparatus as set forth in claim 4 wherein each stabilizer fin inward edge surface further includes a projecting nipple receiving cavity positioned below the stabilizer fin bore, and a semi-circular array of projecting nipples spaced a predetermined radial spacing below the stabilizer fin axle, with the nipples fixedly mounted to the lower cylindrical body, and the projecting nipple receiving cavity of each stabilizer fin arranged for receiving a single of said projecting nipples therewithin, with the projecting nipples spaced a predetermined spacing from the stabilizer fin axle and the projecting nipple receiving cavity spaced the predetermined spacing from the stabilizer fin axle.

* * * * *